United States Patent [19]

Azarniouch et al.

[11] Patent Number: 5,061,343

[45] Date of Patent: Oct. 29, 1991

[54] RECOVERY OF NAOH AND OTHER VALUES FROM SPENT LIQUORS AND BLEACH PLANT EFFLUENTS

[75] Inventors: Mahmoud K. Azarniouch, Dorval; Steven Prahacs, Beaconsfield, both of Canada

[73] Assignee: Pulp and Paper Research Institute of Canada, Pointe Claire, Canada

[21] Appl. No.: 530,800

[22] Filed: May 30, 1990

[30] Foreign Application Priority Data

May 31, 1989 [CA] Canada ..... 601281

[51] Int. Cl.[5] ..... B01D 61/42; D21C 11/00

[52] U.S. Cl. ..... 162/16; 162/29; 162/30.11; 162/37; 162/50

[58] Field of Search ..... 162/16, 29, 30.11, 31, 162/32, 37, 39, 50; 204/98, 131, 151

[56] References Cited

U.S. PATENT DOCUMENTS

| | | | |
|---|---|---|---|
| 2,905,604 | 9/1959 | Kennedy et al. | 204/56.1 |
| 4,213,820 | 7/1980 | Broddevall | 162/29 |
| 4,584,076 | 4/1986 | Edel et al. | 204/151 |

FOREIGN PATENT DOCUMENTS 8204365 2/1983 Sweden .

*Primary Examiner*—Richard V. Fisher
*Assistant Examiner*—Charles Friedman
*Attorney, Agent, or Firm*—Swabey O. Renault

[57] ABSTRACT

Oxidized weak black liquor or effluents from alkaline bleaching stages, particularly oxygen delignification and/or ozone and/or hydrogen peroxide bleaching effluents are treated in process stages which include an electrolytic cell to recover NaOH, lignin, $O_2$, $H_2$ and to achieve other important benefits, the most important of these are (i) to unload the evaporator-recovery furnace and lime-kiln causticizing plant, and (ii) to enable a mill to implement low- or no-chlorine bleaching techniques without overloading their recovery furnace and/or lime kiln or requiring a new, larger recovery system, the electrolytic treatment can be carried out with one or a combination of the above types of effluents; it is also possible to increase the conductivity if required and thus the efficiency of the electrolytic cells and the yield/production of NaOH by the introduction of $Na_2SO_4$ (make-up or recycle from recovery furnace) and/or NaCl into the feed to the process; the process involves pre-acidification of aqueous alkaline liquid containing lignin to initiate precipitation of lignin, feeding the partly acidified liquid to the anolyte compartment of an electrolysis cell in which the anolyte and catholyte compartments are separated by a cation permselective membrane, and in which the catholyte compartment is provided with a source of hydroxide cations by carrying out electrolysis to effect migration of sodium ions into the catholyte compartment, and simultaneously to acidify the liquid in the anolyte compartment to substantially complete lignin precipitation; sodium hydroxide is recovered from the catholyte compartment and lignin is recovered from the anolyte compartment.

18 Claims, 1 Drawing Sheet

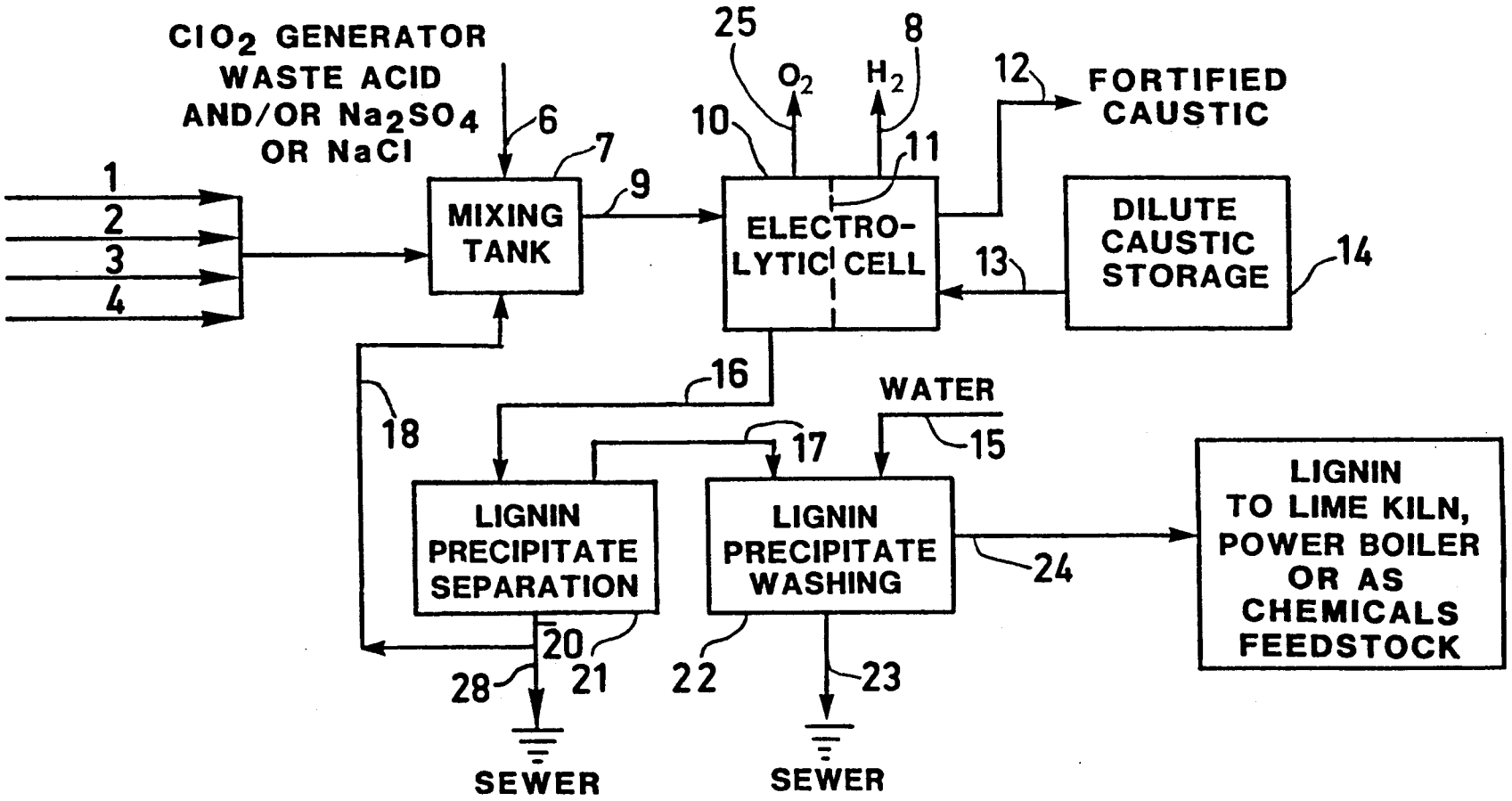
ClO2 GENERATOR WASTE ACID AND/OR Na2SO4 OR NaCl
1
2
3
4
6
7
MIXING TANK
9
ELECTRO-LYTIC CELL
10
11
8
H2
O2
25
12
FORTIFIED CAUSTIC
13
DILUTE CAUSTIC STORAGE
14
16
18
WATER
15
17
LIGNIN PRECIPITATE SEPARATION
20
21
28
SEWER
LIGNIN PRECIPITATE WASHING
22
23
SEWER
24
LIGNIN TO LIME KILN, POWER BOILER OR AS CHEMICALS FEEDSTOCK

RECOVERY OF NAOH AND OTHER VALUES FROM SPENT LIQUORS AND BLEACH PLANT EFFLUENTS

BACKGROUND OF THE INVENTION (i) Field of the Invention

This invention relates to the treatment of pulping liquors and bleaching effluents to recover values.

(ii) Description of Prior Art

The recovery system often represents the ultimate production bottle-neck of the kraft pulping process due to its high capital cost. The purpose of the recovery system is to regenerate NaOH and $Na_2S$, the active pulping chemicals, from the sodium and sulphur in the spent cooking liquor and to utilize the energy value of the spent liquor organic material to produce steam.

The key equipment in the conventional recovery process is the recovery furnace where the sodium and sulphur content of the black liquor are reduced to $Na_2S$, and the organic solids are combusted to produce heat for steam generation. In the furnace, sodium also combines with the organic material to produce $Na_2CO_3$, which is then causticized with lime. Lime is produced by calcining calcium carbonate, which is recovered during the causticizing operation, in a kiln. The fossil fuel requirement of the lime kiln is one of the principle obstacles preventing kraft pulp mill from becoming independent of purchased fuels.

The reduction capacity of a typical furnace is usually far greater than the combustion and heat recovery capacities, and studies have shown that furnaces can operate at inorganic/organic ratios considerably higher than those found in black liquor. Removal of a portion of the organic material from the spent liquor could therefore be an attractive means of providing incremental recovery capacity for a kraft pulp mill.

The only proven method for unloading a recovery furnace, without chemical losses, is the fluidized bed incineration of a portion of the black liquor. In this system a portion of the black liquor, at approximately 30% solids, is diverted from the evaporators and fired into a fluidized bed incinerator, where the organic material burns and pellets of a mixture of $Na_2SO_4$ and $Na_2CO_3$ are recovered. The 0.3–2 mm pellets are then fed into the reducing zone of the recovery furnace. This system, however, has two distinct disadvantages. First, the fluidized bed has a poor steam generating capacity and low overall energy efficiency due to the low solids content of the feed, typically 30 to 35%, by weight, which is required to avoid excessive bed temperature and partial fusion. Secondly, the sodium sulphate reduction efficiency in the recovery furnace is adversely affected because of the non-homogenity of the feed and the very high sulphate load resulting from this mode of operation.

Another method which has been proposed for removing organic material from black liquor is acid precipitation. This process, however, has the disadvantages of having high sodium losses, significant chemical consumption and yield of a precipitate with a high moisture content.

In the patent and technical literature, methods based on electrolysis have been described to obtain essentially pure sodium hydroxide and organic lignin-based material from kraft black liquor.

Kennedy, U.S. Pat. No. 2,905,604 describes a process designed to increase the alkalinity of black liquor for recycle to the digesters and teaches an apparatus consisting of a revolving drum, which forms the anode, in a basin, which forms the cathode, of black liquor. Black liquor is continuously fed into the basin where lignin deposits on the anode drum, and NaOH forms near the basin cathode, thus yielding a liquor of increased alkalinity. Lignin is continuously scraped from the drum, washed and dried.

U.S. Pat. No. 4,584,076 Edel et al describes tests carried out with sulphur-free soda spent liquors treated in an electrolysis cell, consisting of an anode and a cathode compartment separated by a cation selective membrane. In a two-stage experimental set up the anolyte pH was reduced from 13.6 to 9.5 and subsequently to a pH of 5. Lignin was recovered from the foam layer of the anolyte chamber by drying and sodium hydroxide was recovered into a 0.1 N NaOH solution of the catholyte chamber.

The electrolytic methods described in the prior art do not provide a solution for the recovery of sulphur in usable form, i.e., as $Na_2S$, and hence cannot provide a viable alternative to the kraft recovery process. There remains, however, a need in the art for an energy efficient and cost-effective incremental kraft recovery process in order to alleviate the problem of overloaded recovery systems.

According to the best knowledge of the Inventors, there is no directly relevant prior art to the specific application of electrolytic recovery of NaOH and other values (lignin, other organic compounds, $H_2SO_4$, $H_2$, $O_2$ or $O_2/Cl_2$ mixture) from the process streams or combination thereof covered in this disclosure.

Similarly the Inventors have no knowledge of any description or proposed use of the techniques of this invention for enabling pulp mills to implement an oxygen delignification step between pulping and bleaching without having to overload or replace their existing pulping chemicals recovery system composed of evaporators, recovery furnace, lime kiln and causticizing plants.

SUMMARY OF THE INVENTION

The present invention provides for the following features:

(a) provision of incremental capacity for both the evaporator-recovery furnace and lime kiln-causticizing plant in kraft pulp mills to increase the pulp production capacity.

(b) provision of incremental chemical recovery capacity for a mill installing an oxygen delignification step preceding their bleaching process.

(c) provision of incremental NaOH recovery capacity for a kraft or sulphite pulp mill that wishes to replace chlorine bleaching partly or completely with chlorine-free or chlorine- and chlorine dioxide-free bleaching technology.

In accordance with the invention values are recovered from a pulping liquor or bleaching effluent, more especially from an aqueous, alkaline liquid containing combustible organic material comprising lignin.

The process of the invention comprises a first step in which the liquid is acidified to a pH effective to initiate lignin precipitation and a second step in which partly neutralized liquid is recovered and subjected to acidification to precipitate lignin which is recovered. At least one of the first and second acidification steps includes an electrolytic acidification in which the liquid containing lignin is fed to the anolyte compartment of an electrolysis cell, in which the anolyte compartment is separated from the catholyte compartment by a cation permselective membrane.

The acidification in the electrolytic cell is carried out with electrolysis under conditions in which lignin precipitates in the anolyte compartment and sodium ions migrate through the membrane to the catholyte compartment to generate sodium hydroxide solution with hydroxide ions in the catholyte compartment.

Lignin and sodium hydroxide solutions are both recovered in the process.

DESCRIPTION OF PREFERRED EMBODIMENTS (i) Two Step Acidification

In a first embodiment of the invention the process is carried out with two distinct acidification steps, one being essentially chemical acidification and the other electrolytic acidification.

In a first step the liquid is acidified to a pH effective to initiate lignin precipitation; this pH is typically about 9 to 10. The partly neutralized liquid is fed into the anolyte compartment of an electrolytic cell and a source of hydroxide cations is established for the catholyte compartment; a cation permselective membrane separates the anolyte and catholyte compartments. The partly neutralized liquid is acidified in the anolyte compartment by electropotential, in the presence of sodium cations, to a pH effective to substantially complete precipitation of lignin, and electrolysis is carried out resulting in migration of sodium cations from the anolyte compartment to the catholyte compartment; acidification in this stage is typically to a pH of about 3 to about 4. The electropotential results in hydrogen ions generated in the anolyte compartment during the electrolysis; in particular in the presence of sodium sulphate, the hydrogen ions and sulphate ions provide sulphuric acid in the anolyte compartment. Sodium hydroxide solution is recovered from the catholyte compartment and precipitated lignin is recovered from the anolyte compartment.

The pre-acidification may suitably be carried out with a by product of the kraft mill, in particular, waste acid from a chlorine dioxide generator which contains sulphuric acid and sodium sulphate and thus provides make-up sodium ions for sodium lost with the spent liquor leaving the anolyte compartment.

In a particular embodiment the process is applied to 10 to 20% of the weak black liquor, coming from the brown stock washers of the kraft pulping process, corresponding to the overload capacity of the kraft recovery furnace. This liquor is separated from the main weak black liquor stream prior to the multiple effect evaporators and is oxidized prior to the acidification stages. The oxidation prevents the evolution of $H_2S$ during the acidification of the weak black liquor.

Oxidation may suitably be achieved by blowing air or oxygen into the liquor at a temperature of typically at least 70° to 75° C. or in any other way known to those familiar with the art.

The first chemical pre-acidification corresponds to the onset of lignin precipitation and the second, electrolytic acidification corresponds to near-complete lignin precipitation.

In the second acidification stage, the weak black liquor is passed into the anode compartment of an electrolytic cell and simultaneously sodium hydroxide is regenerated in the cathode compartment. In order to provide a good alkali separation a cation permselective ion exchange membrane is placed between the anode and cathode compartments. Upon acidification lignin based solids precipitate in the acidified weak black liquor and are separated as a cake of 40 to 50% solids content and can be used as a source of chemicals or as fuel.

(ii) Three Step Acidification

In a second embodiment of the invention the process is carried out with three acidification steps comprising two electrolytic acidification steps separated by a chemical acidification step.

These steps are carried out under conditions similar to those of the two-step acidification.

In this embodiment the first acidification is an electrolytic acidification, of the type described for the two-step process typically to a pH of 9 to 10 corresponding to initiation of lignin precipitation; usually this will achieve precipitation of less than 5%, by weight, of the lignin. A first stage recovery of sodium hydroxide solution is made from the catholyte compartment of the cell.

A partly electrolyzed, partly neutralized liquid is removed from the anolyte compartment of the cell and is acidified chemically to achieve precipitation of a major portion of the lignin, typically a portion in excess of 75%, by weight, of the lignin. This acidification is suitably to a pH of 5 to 7 and may be achieved, for example, with waste acid from a chlorine dioxide generator and which thus contains an aqueous solution of sulphuric acid and sodium sulphate, or with recycled product acid produced in the process of the invention.

The lignin precipitated during the chemical acidification is separated out and the lignin depleted liquid is passed to a second electrolytic acidification in an electrolytic cell of the character described previously. In this electrolytic acidification, a pH of about 2 is typically achieved and residual lignin is precipiated and recovered from the anolyte compartment. The residual lignin typically comprises about 10%, by weight, of the original total lignin content. Aqueous sodium hydroxide solution is generated in the catholyte compartment, as described previously, and is recovered from such compartment.

One part of the product acid may be recycled back to the chemical acidification stage and another part may be reintroduced into the main weak black liquor stream of the pH prior to entering multiple effect evaporators.

The principal benefits of the three-step acidification are high recovery of the sodium, typically over 75% in the weak black liquor as sodium hydroxide, and minimization of the amount of precipitated lignin in the weak black liquor treated in both electrolytic stages, since precipitated lignin may cause operational problems in the electrolytic cells.

(iii) Other Process Aspects

In another embodiment of the process, effluents from alkaline bleaching stages, particularly oxygen delignification and/or ozone and/or hydrogen peroxide bleaching effluents are treated by the process of the invention including electrolytic cells to recover NaOH, $O_2$, $H_2$ and to achieve other important benefits. The most important of these is to enable a mill to implement low- or no-chlorine bleaching techniques without overloading the recovery furnace and/or lime kiln or requiring a new, larger recovery system. The electrolytic treatment might be carried out with one or a combination of the above types of effluents. It is also possible to increase the conductivity and thus the efficiency of the electrolytic cells and the yield/production of NaOH by the introduction of generator waste acid, $Na_2SO_4$ make-up or recycle from recovery furnace, and/or NaCl and/or oxidized black liquor into the feed to the process. The $O_2$ or possibly $O_2$ and $Cl_2$, if NaCl is present, can be used in the bleaching process after some increase in the pressure by the use of blowers and/or ejectors driven by pressurized $O_2$ or steam.

After electrolytic treatment the acidified sodium and lignin-depleted liquor originating from the weak black liquor or bleach plant effluent is discharged through the effluent treatment plant of the mill.

The principal benefit of the proposed process and its various possible embodiments is providing an alternative to the expansion or replacement of recovery furnace, lime kiln, evaporators, etc. in a kraft mill wishing to expand its capacity and/or reduce the production of organic chlorides by oxygen delignification and/or other suitable means.

The process of the present invention is generally applicable to the kraft pulping process but is especially useful for those kraft pulping operations which cannot further increase their pulp production capacity due to a highly overloaded chemical recovery system, in particular the recovery boiler.

BRIEF DESCRIPTION OF DRAWINGS

The invention will be more fully understood from the description which follows taken in conjunction with the drawing which is a schematic flow diagram showing one embodiment of the present invention incorporated into the kraft black liquor cycle.

DESCRIPTION OF PREFERRED EMBODIMENTS WITH REFERENCE TO THE DRAWINGS

Streams 1 to 4 can be fed separately or in appropriate combinations, and they can represent, as examples, 1: oxidized black liquor; 2: $O_2$ delignification process effluent; 3: extraction (e.g. $E_o$) stage effluent; 4: effluent from another bleaching stage (e.g. $H_2O_2$, $O_3$). For matters of simplicity only oxidized weak black liquor is described here, i.e. stream 1. Stream 1 is passed into the mixing tank 7 where the pH of the weak black liquor is reduced down to 9 to 10 corresponding to the onset of lignin precipitation. The pH reduction of the weak black liquor to 9 to 10 in the mixing tank 7 is carried out by addition of stream 6 which can be $ClO_2$ generator waste acid consisting mainly of an aqueous solution of $H_2SO_4$ and $Na_2SO_4$ which is available in many kraft mills on-site as a by-product of the bleaching chemical $ClO_2$ production facility. This step is beneficial in various ways: (i) it recovers much of the sodium in the waste acid directly as NaOH in the subsequent electrolysis, (ii) energy is saved by carrying out the acidification of streams 1–4 and alkali recovery in two stages, and (iii) since, as $ClO_2$ generator waste acid is commonly added to strong black liquor, and causes in many mills operational problems due to lowering of the pH of the strong black liquor before firing in the furnace, this problem is avoided by adding the waste acid as described in this invention. If no generator waste acid is available, stream 6 may be an appropriate solution of $Na_2SO_4$ or NaCl.

The second stage of weak black liquor acidification is carried out by passing the oxidized and partly acidified weak black liquor 9 leaving the mixing tank 7 into the anode compartment of the electrolytic cell 10 where it is acidified to a pH of 3 to 4. In the cathode compartment of the electrolysis cell 10 sodium hydroxide is continuously produced by passage of sodium ions through a cation selective ion exchange membrane 11 into a dilute caustic solution 13 coming from a dilute caustic storage 14. The fortified caustic soda 12 leaves the cathode compartment of the electrolysis cell 10 and is used in pulping liquor preparation. Upon acidification to a pH of 3 to 4, precipitation of lignin based solids in the weak black liquor occurs and the treated liquor 16 is passed to a lignin precipitate separation unit 21 which can be a vacuum filter, a centrifuge or any other suitable solid liquid separation device known to those familiar in the art. The separated lignin solids 17 have a consistency of 40 to 50% and are conveyed to a washer 22. Washing is accomplished with hot water 15 which could be fresh water or any suitable process water in order to clean the lignin solids 17 from residual inorganic chemicals. The wash water 23 which contains some sodium and sulphur compounds as well as some nonlignin, wood based organic compounds is normally sewered. Additional sodium and sulphur losses consist of those adhering to the recovered lignin solids 17 and are minimal. These pulping chemical losses are compensated for by the addition of the make-up stream 6, e.g. $ClO_2$ generator waste acid, or in absence of it by $Na_2SO_4$ which are usual and customary sources of pulping chemicals make-up for the kraft process or NaCl.

A rather pure lignin product 24 is obtained and can be used as fuel for the lime kiln, in the power boiler or as feedstock for production of e.g. phenolic adhesives, plastics or other chemicals or used as a polymeric material per se. The lignin and sodium depleted anolyte liquor 20 contains mainly wood based sugars, sulphuric acid as well as some residual sodium as sodium sulphate and residual non-precipitated lignin. The spent anolyte liquor 20 is split into two streams: stream 18 is recycled back to the process and a surplus stream 28 is sewered. In the absence of $ClO_2$ generator waste acid 6, the pre-acidification of streams 1–4 in the mixing tank 7 is carried out by stream 18. In presence of $ClO_2$ generator waste acid, no spent anolyte liquor recycle 18 may be necessary to be passed into the mixing tank 7 and stream 28 equals to the totality of stream 20.

The hydrogen gas 8 generated in the catholyte chamber can be burnt in the lime kiln or in the power boiler. In the anolyte compartment an oxygen rich gas 25 is produced which can be used in the bleaching process.

In order to illustrate the invention electrolysis of weak black liquor was carried out in a series of tests with a laboratory batch cell consisting of an anode and a cathode compartment. The anode compartment contained weak black liquor and the cathode compartment contained a 6% (weight basis) NaOH solution. The membrane area was 100 $cm^2$ and the anode-membrane and cathode-membrane gaps were 10 and 25 mm, respectively. The membrane used was DuPont's Nafion N-324 (cationic). The cell's performance using both stainless steel and graphite electrodes was examined. At an anolyte pH of 3 to 4 sodium recoveries were between 70 and 80%. For sodium recovery of 95% the pH of the anolyte has to be brought down to around 2. At an anolyte pH of 4 the precipitated organic material accounted for over 50% of total original organic content of the black liquor which in turn represents virtually all the lignin-based organic solids. The solids content of the filtered lignin precipitate was over 40% when the electrolysis was carried out at a temperature of 60 to 80° C.

The cell power consumption was between 3 and 6 kWh/kg NaOH produced at sodium recoveries of 70 to 90%. The following example, which is based on the electrolysis tests illustrates the benefits derived from this invention.

EXAMPLE

A typical 800 tonnes per day Kraft pulp mill has increased its pulp production to the point where its recovery furnace is 5% overloaded (i.e., organics overloaded). In order to maintain this production, the mill is presently discharging 2.5% of its black liquor to the sewers, and feeding the balance to the furnace. The energy value of the 2.5% overload organics cannot, however, be recovered as steam due to the physical constraints of the furnace. The sodium in the sewered black liquor is made up with purchsed caustic.

The mill will eliminate the liquor losses, and recuperate the heating value of the uncombusted organics by implementing the process described in this invention to treat 10% of its weak black liquor stream.

The following energy benefit can be derived for 95% sodium recovery:

| | |
|---|---|
| Fuel value of lignin precipitate | 447,385 GJ/year |
| Fuel savings in lime kiln | 55,175 GJ/year |
| Fuel value of hydrogen produced | 39,255 GJ/year |
| Credit | 541,815 GJ/year |
| Electricity consumption for electrolysis | 176,060 GJ/year |
| Decreased black liquor solids to furnace | 69,700 GJ/year |
| Increased evaporation load | 16,700 GJ/year |
| Debit | 262,460 GJ/year |
| New energy benefit | 279,355 GJ/year |

For this example the following benefits were derived:

(i) A net energy gain of the equivalent of 44,000 barrels of oil/year.

(ii) A net savings of about 3,000 t NaOH/year.

(iii) Increased pulp production.

(iv) Reduced air pollution control cost.

(v) Reduced effluent treatment cost.

There are about 300 tonnes/year sulphur losses with the lignin precipitate wash water 23 which can be substituted by shifting to increased salt cake make-up and/or direct sulphur make-up.

Although this invention has been described in its preferred forms and preferred practice with a certain degree of particularity, it is understood that the present disclosure of the preferred form and preferred practice has been made only by way of example and that numerous changes in the details of the combination and arrangement of parts and steps may be resorted to without department from the spirit and scope of the invention.

We claim:

1. A process for recovering pulping chemicals and lignin and other combustible materials from an aqueous, alkaline liquid containing combustible lignin, which comprises:

(i) electrolytically acidifying an aqueous, alkaline liquid containing combustible organic material comprising lignin to a pH effective to initiate lignin precipitation from said liquid with less than 5% weight of the lignin in said liquid being precipitated and recovering a partly neutralized liquid, (ii) chemically acidifying the recovered partly neutralized liquid to precipitate a major portion of the lignin therein, in excess of of 75%, by weight, of the lignin content of the liquid being precipitated, and separating the precipitated lignin from the chemically acidified liquid to leave a lignin depleted acidified liquid, (iii) electrolytically acidifying the depleted acidified liquid to precipitate residual lignin, and (iv) recovering precipitated lignin, and wherein steps (i) and (iii) each include an electrolytic acidification in which liquid containing lignin is fed to an anolyte compartment of an electrolysis cell, said cell having a catholyte compartment separated from said anolyte compartment by a cation permselective membrane, and comprising:

(a) carrying out said electrolytic acidification by electropotential to split water in said anolyte compartment and produce $H^+$ ions in the presence of sodium ions, (b) effecting electrolysis in said cell, (c) maintaining an aqueous source of hydroxide ions in said catholyte compartment and allowing said sodium ions in said anolyte compartment to migrate through said membrane into said catholyte compartment to generate an aqueous sodium hydroxide solution in said catholyte compartment, (d) recovering aqueous sodium hydroxide solution from said catholyte compartment, and (e) recovering an acidic solution from said anolyte compartment.

2. A process according to claim 1, wherein step (i) comprises acidification to a pH of 9 to 10, step (ii) comprises chemically acidifying to a pH of 5 to 7 and step (iii) comprises acidification to a pH of about 2.

3. A process according to claim 2, in which said aqueous, alkaline liquid is derived from a Kraft pulping operation; and in which said aqueous sodium hydroxide solution recovered is fed to a pulping liquor preparation stage of said Kraft pulping operation.

4. A process according to claim 3, in which the recovered lignin is fed as a fuel to a lime kiln of said Kraft pulping operation.

5. A process according to claim 4, wherein at least part of the chemical acidification of step (ii) is carried out with a waste acid mixture consisting essentially of an aqueous solution of sulphuric acid and sodium sulphate from a chlorine dioxide generator, said waste acid providing part of the sodium ions requirement, and said sulphate providing sulphate ions which form sulphuric acid with the $H^+$ ions in said anolyte compartment generated by said equipotential.

6. A process according to claim 5, wherein said aqueous, alkaline liquid is an oxidized black liquor derived from said Kraft pulping operation.

7. A process according to claim 1, wherein said aqueous, alkaline liquid is an effluent from an oxygen delignification in a Kraft pulping operation.

8. A process according to claim 1, wherein said aqueous, alkaline liquid is a bleaching effluent in a Kraft pulping operation.

9. A process according to claim 1, including recovering hydrogen gas as a value from said catholyte compartment and oxygen gas as a value from said anolyte compartment.

10. An incremental process for recovering pulping chemicals and lignin and other combustible materials from an aqueous, alkaline Kraft black liquor containing sulphur values and combustible lignin in a Kraft recovery system of a Kraft pulping operation which comprises:

(i) removing an overload capacity of a Kraft recovery system as a stream comprising 10 to 20% of the black liquor in said Kraft recovery system, (ii) providing a first electrolysis cell having an anolyte compartment and a catholyte compartment separated by a cation permselective membrane, (iii) feeding said stream of black liquor from (i) into said anolyte compartment of said first electrolysis cell, (iv) electrolytically acidifying said black liquor in said anolyte compartment by electropotential to split water in said anolyte compartment and produce $H^+$ ions, in the presence of sodium ions, to a pH effective to initiate lignin precipitation from said black liquor with less than 5%, by weight, of the lignin in said black liquor being precipitated, and recovering a partly neutralized black liquor from said anolyte compartment, (v) effecting electrolysis in said cell, (vi) maintaining an aqueous source of hydroxide ions in said catholyte compartment and allowing said sodium ions in said liquor in said anolyte compartment to migrate through said membrane into said catholyte compartment to generate an aqueous sodium hydroxide solution, (vii) chemically acidifying the recovered partly neutralized black liquor to precipitate a major portion of the lignin therein, in excess of 75%, by weight, of the lignin content of the black liquor in (i), and separating the precipitated lignin from the chemically acidified liquor to leave a lignin-depleted acidified liquor, (viii) providing a second electrolysis cell having an anolyte compartment and a catholyte compartment separated by a cation permselective membrane, (ix) feeding said lignin-depleted acidified liquor to said anolyte compartment of said second electrolysis cell, (x) electrolytically acidifying said lignin-depleted acidified liquor in said anolyte compartment of said second electrolysis cell by electropotential to split water in the said anolyte compartment and produce $H^+$ ions, in the presence of sodium ions, to precipitate residual lignin, (xi) effecting electrolysis in said second electrolysis cell, (xii) maintaining an aqueous source of hydroxide ions in said catholyte compartment of said second electrolysis cell and allowing said sodium ions in (x) to migrate through said membrane into said catholyte compartment to generate an aqueous sodium hydroxide solution, (xiii) recovering aqueous sodium hydroxide solution from said catholyte compartments of said first and second electrolysis cells, (xiv) recovering an acidic solution from said anolyte compartment of said second electrolysis cell, and (xv) recovering the precipitated lignin as a value.

11. A process according to claim 10, in which said aqueous sodium hydroxide solution recovered is fed to a pulping or bleaching liquor preparation stage of said Kraft pulping operation.

12. A process according to claim 11, in which said lignin recovered in (xv) is fed as a fuel to a lime kiln of said Kraft pulping operation.

13. A process according to claim 12, wherein step (xv) comprises separating precipitated solids and washing the separated solids to remove nonlignin solids.

14. A process according to claim 13, wherein at least part of said acidifying in (vii) is carried out with a waste acid mixture consisting essentially of an aqueous solution of sulfur acid and sodium sulphate from a chlorine dioxide generator, said waste acid providing part of said sodium ions of step (x).

15. A process according to claim 14, wherein a first part of the acidic solution in (xiv) is recycled to step (vii) for said acidifying.

16. A process according to claim 10, wherein said acidifying in (iv) is to a pH of 9 to 10, said acidifying in step (vii) is to a pH of 5 to 7 and said acidifying in (x) is to a pH of about 2.

17. A process according to claim 10, wherein said black liquor is an oxidized black liquor derived from a Kraft pulping operation.

18. A process according to claim 17, wherein said oxidized black liquor is a weak oxidized black liquor and said 10 to 20% of the oxidized black liquor in (i) is derived from a brown stock washer of said Kraft pulping operation.

* * * * *